United States Patent [19]

Naegeli

[11] Patent Number: 4,531,614

[45] Date of Patent: Jul. 30, 1985

[54] FORK TRUCK SERVICE LIFT

[75] Inventor: Robert W. Naegeli, Edmond, Okla.

[73] Assignee: Autoquip Corporation, Guthrie, Okla.

[21] Appl. No.: 516,875

[22] Filed: Jul. 25, 1983

[51] Int. Cl.[3] ..... B66F 7/16

[52] U.S. Cl. ..... 187/8.5; 187/8.41; 254/89 H

[58] Field of Search ..... 187/8.43, 8.45, 8.5, 187/8.54, 8.74, 8.41; 254/89 H, 89 R

[56] References Cited

U.S. PATENT DOCUMENTS

| | | | |
|---|---|---|---|
| 3,838,783 | 10/1974 | Tune | 187/8.43 X |
| 3,920,101 | 11/1975 | Richards | 187/1 R X |
| 4,267,901 | 5/1981 | Tsujimora | 187/8.54 |
| 4,328,951 | 5/1982 | Laupper | 187/8.5 X |

OTHER PUBLICATIONS

"Fork Truck Service Lifts", Autoquip Corporation, 1973, 8 pages.

*Primary Examiner*—Joseph J. Rolla
*Assistant Examiner*—Nils E. Pedersen
*Attorney, Agent, or Firm*—Niro, Jager & Scavone, Ltd.

[57] ABSTRACT

A portable hydraulic service lift for elevating equipment such as industrial vehicles. The lift includes a base assembly including a platform which supports the elevated lift and allows the lift to be readily moved to a different location. A pair of rigid support legs extend upwardly from one end of the base platform and are spaced transversely to receive a portion of the equipment to be elevated therebetween. A pair of elongate lifting arms are joined in a cantilevered fashion to the support legs along the sides of the base platform. Rollers join the lifting arms to the adjacent support leg so that the arms can be raised and lowered in a cantilevered fashion while rolling along the support legs. Lifting bars extending transversely across the lifting arms are adapted to engage with the underside of the vehicle to be lifted. Power lifting mechanism are provided to raise and lower the arms and the vehicle supported on the lifting bars. Safety locking mechanism connected between said lifting arms and support legs releasably locks the arms in any of a plurality of positions. Control mechanism are also provided to energize the lifting mechanism and safety locking mechanism to selectively raise and lower said arms and said equipment.

12 Claims, 7 Drawing Figures

24
28
26
22

126
124
120
100
140
242
144
10
"F"
60
55
66
44
42
30
40
68
5
5
150
58
132
130
126
50
52
176
172
170
24
26
28
20
23
22

54
55
59
60
58
53
52
56
50
62
57
100
122
60
61
65
67
66
32
111
64
58
50
112
67
68
159
132
130
65
160
178
156
157
158
152
174
154
155
126
150
172

FORK TRUCK SERVICE LIFT

BACKGROUND OF THE INVENTION

This invention relates to a hydraulic lift system in general, and in particular relates to a hydraulic service lift for fork lift trucks and the like.

Industrial vehicles such as fork lift trucks are in need of constant repair and maintenance. A substantial amount of the maintenance and repair work on such industrial vehicles, such as oil and grease jobs, transmission repair, wheel bearing packing and the like, requires the vehicle to be elevated for ready access to the undercarriage. Thus, there is a need for a service lift to elevate the vehicle. Also, since downtime for vehicles such as fork lift trucks is expensive, it is desirable to have the service and repair facility for the trucks as close as possible to the point of normal use of the equipment.

Accordingly, there is a demand for portable hydraulic lift equipment which will efficiently and safely elevate fork lift trucks and the like for service and repair and which is sufficiently portable to be conveniently moved from location to location, as the need arises. To facilitate service and repair operations, the portable lift should provide maximum unobstructed access to the under-side of the truck being serviced. To minimize labor costs and to facilitate portability, the lift should be readily installed at different locations without using mounting devices such as lag bolts to secure the lift in the desired position. The lift also should be compact and light weight while having a high-loading capacity. The lift design should further include safety features which eliminate potentially dangerous or obstructing parts, such as scissor lifting arms and the like.

The above objects are accomplished by the present invention which provides a portable, hydraulically operated, service lift having a cantilevered design. The lift in accordance with this invention will readily receive industrial equipment such as fork lift trucks and is sufficiently portable to be moved to any location which is convenient for servicing the trucks on a regular basis. Since no mounting bolts are needed, the lift likewise can be moved to a new location as the need arises. The cantileverd design provides substantial and unobstructed access to the under-side of the elevated equipment for easy service and repair. The lift is designed to have safety locking features which signal the locked or unlocked condition of the lift and guard against accidental lowering. At the same time, the lift structure provides a strong assembly having a high loading capacity and a compact design. Efficient hydraulic rams are used to elevate the cantilevered platform directly, thereby eliminating the need for other lifting devices, such as scissor arms, which may obstruct the access to the underside of the elevated equipment.

DESCRIPTION OF AN ILLUSTRATIVE EMBODIMENT

Further objects and features of the present invention will become apparent from a description of an illustrative embodiment thereof, taken in conjunction with the accompany drawings, in which.

Figures 4, 5:
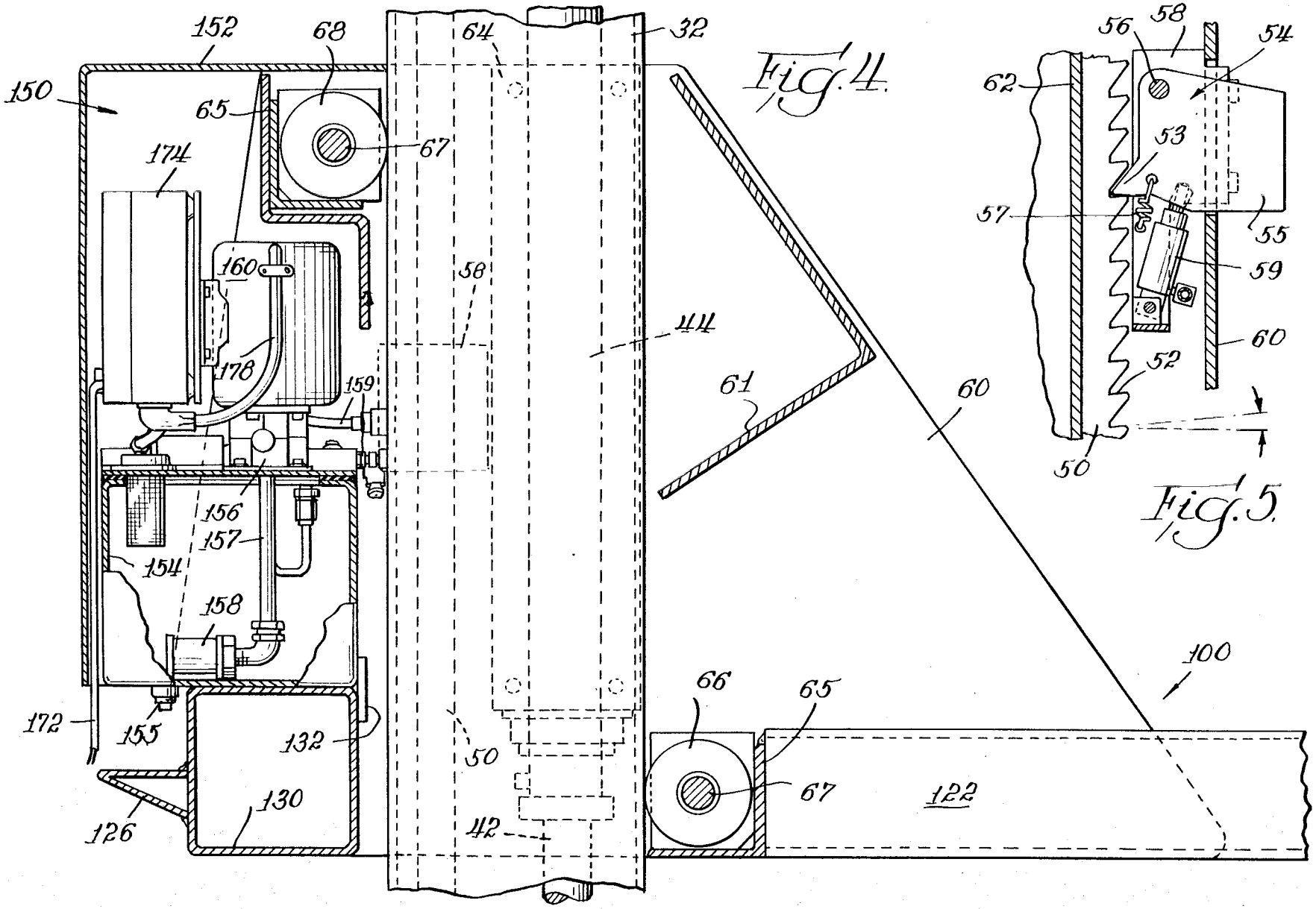

FIG. 4 is an enlarged elevational and cross-sectional view of the power unit employed in the service lift of this invention to raise and lower the platform assembly with respect to the bare assembly; and FIG. 5 is an enlarged and removed cross-sectional view of the automatic mechanical safety mechanism incorporated in the service lift to prevent accidental lowering of the platform assembly from a raised position.

Referring to the drawings, the service lift in accordance with this invention is generally indicated by the reference numeral 10. This service lift is particularly suited for elevating equipment such as the fork lift truck F illustrated in phantom in FIG. 1. The lift 10 can raise truck F for complete access by a mechanic for servicing the undercarriage and the wheel assemblies. Pursuant to this invention, the lift 10 can accomplish this function of elevating truck F without being fixed in place with lag bolts or the like. Instead of being fixed, lift 10 is portable, and can be placed at any desired location within a plant or factory to facilitate the servicing of equipment such as truck F. The design of the lift 10 also provides a substantially open area below the elevated equipment to facilitate the maintenance and repair activities. Safety features are also built into the lift to prevent accidental lowering of the elevator platform assembly.

Figures 1, 1A:
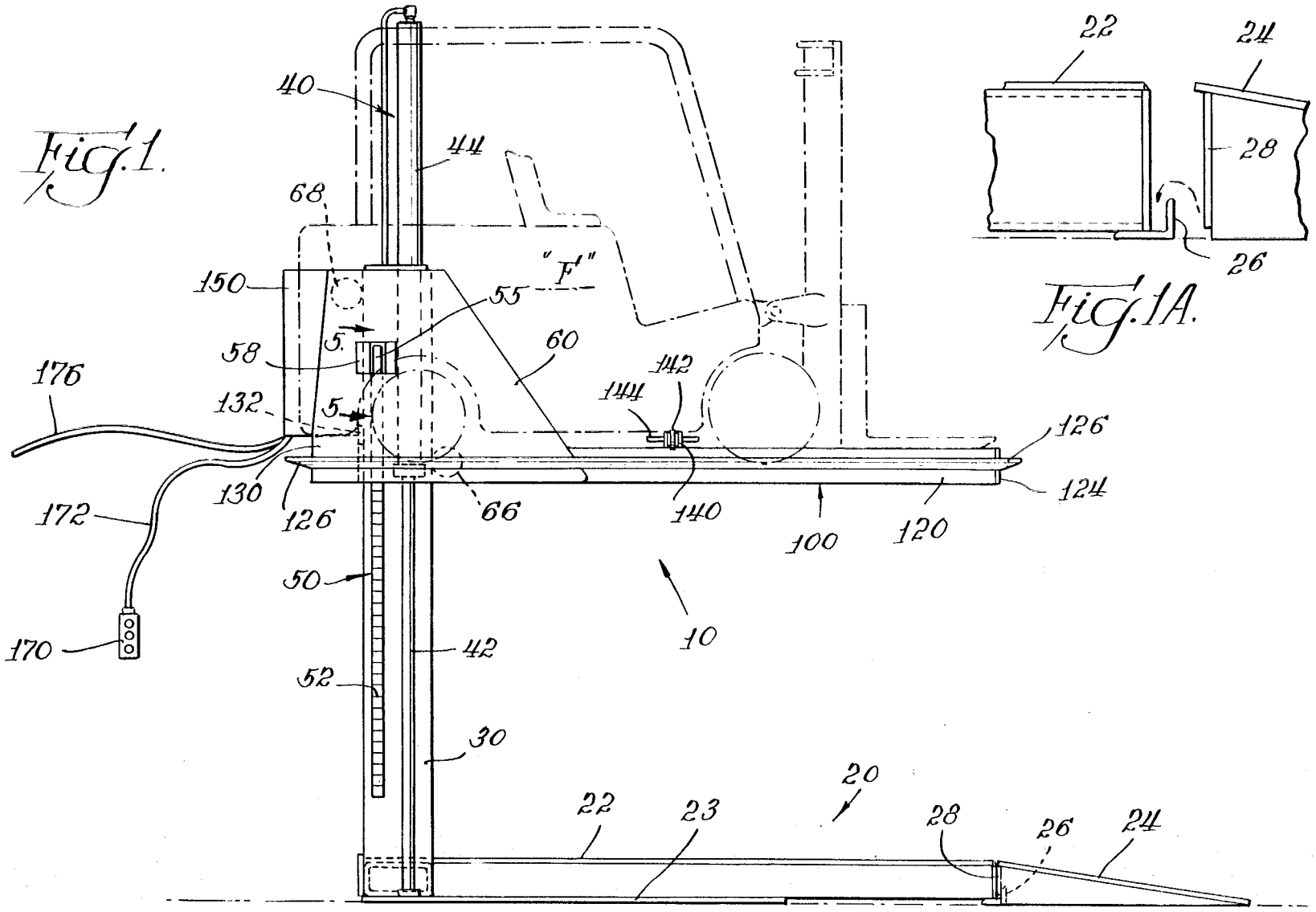
FIG. 1 is a side elevational view of a service lift embodying the features and advantages of the present invention.
FIG. 1A is a removed and enlarged partial sectional view illustrating the mechanical attachment between the aproach ramp and the base of the service lift shown in FIG. 1.

The lift 10 includes a base assembly 20 for firmly supporting the lift 10 in the desired position in a factory where the servicing of the equipment such as the truck F is to be performed. The base assembly 20 includes a horizontal stationary platform 22 and an approach ramp 24. As shown in FIG. 1A, the approach ramp 24 is mechanically engaged with the platform 22 by a tongue and groove connection defined by a flange 26 provided on the platform 22 which receives the lower portion of a back plate 28 on the ramp 24. By this arrangement, no tools are required for attaching the approach ramp 24 to the base 22 or for removing the ramp when it is desired to move the lift 10 to a new location or into storage. Both the ramp 24 and the platform 22 are constructed from welded steel plates and have a non-slip top deck surface. When the ramp 24 is firmly affixed to the base platform 22, the ramp and the platform provide a continuous surface for driving the truck F onto the lift 10 and for servicing the truck F after it is elevated into the service position as shown in FIG. 1.

Figure 2:
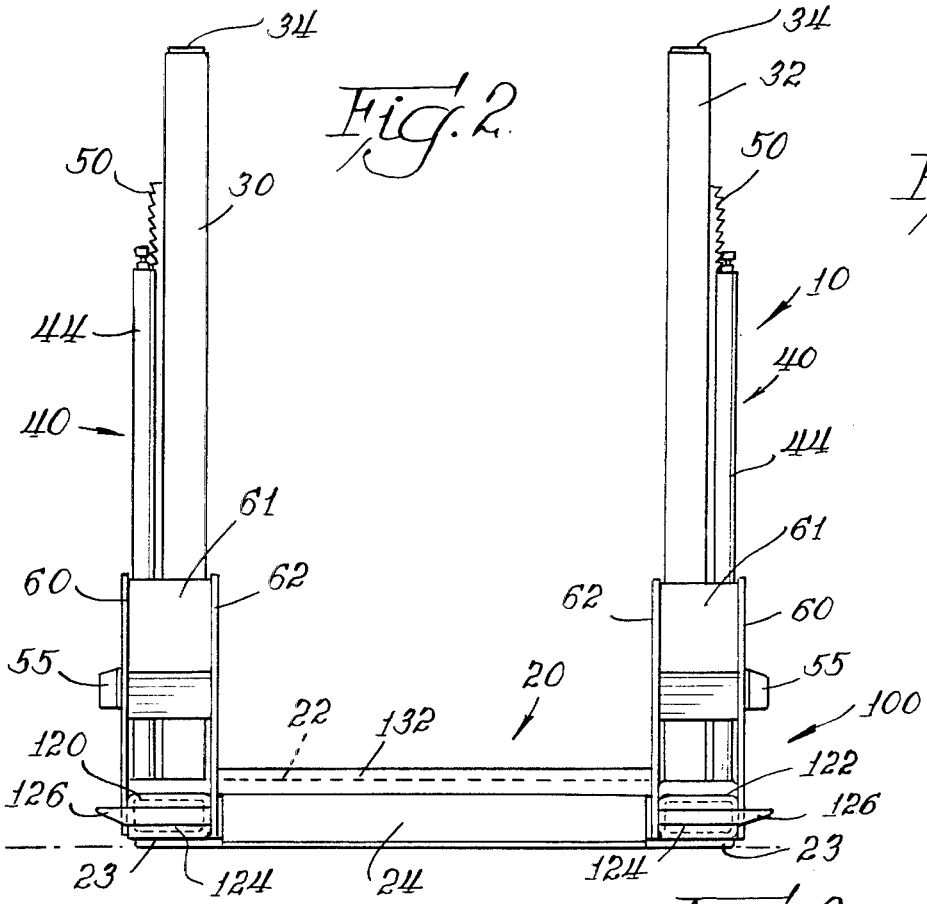
FIG. 2 is a front end view of the service lift shown in its lowered position, as viewed from the right-hand side of FIG. 1.

The base assembly 20 also includes a pair of vertically extending support legs 30 and 32. As shown in FIGS. 1 and 2, these legs 30 and 32 are firmly affixed to the outside rear edges of the base platform 22. These legs are preferably made from high-strength steel and are securely welded to the base platform 22. Each leg 30 and 32 has a box-beam configuration for strength and rigidity. As shown in FIG. 3, the platform 22 includes a laterally extending support plate 23 on each side upon which the legs 30 and 32 are secured. The support plates 23 add rigidity to the juncture between the legs and the base platform 22. The top of each of the support legs is closed by a cap 34.

As shown in FIG, 2, the support legs 30 and 32 are spaced horizontally by a selected substantial distance which defines the maximum space for receiving the end of the truck F. To maximize this internal horizontal width dimension, the inside portions of these legs 30 and 32 are unobstructed, and the lifting and locking mechanisms on the lift 10 are provided adjacent the outside face of each of the legs.

In this regard, a hydraulically operated lifting ram 40 is positioned adjacent each leg. Each ram 40 comprises a hard, preferably chrome plated steel cylindrical rod 42 at the lower portion, connected to the support plate 23 of the base platform 22. Each ram 40 also includes a hydraulic cylinder 44 at its upper end which telescopically receives the rod 42. As described further below, the extension of the rams 40 operates to elevate the truck F above the base platform 22 into a position for service. Likewise, the relief of the hydraulic pressure within the rams 40 permits gravity to lower the truck F downwardly onto the base platform 22. As illustrated in FIGS. 2 and 3, the hydraulic rams 40 are spaced along the outside of each of the support legs 30 and 32 so that the rams do not interfere with the access opening between the support legs.

The lift 10 also includes an automatic safety locking system to prevent accidental lowering of the lift. Part of the safety locking mechanism comprises an elongate locking ratchet 50 mounted on the outer face of each of the support legs 30 and 32. Each ratchet 50 extends a substantial length along the adjacent support leg and is designed to provide an automatic mechanical lock for the elevated lift 10 at a selected interval throughout the operating range of the lift. As shown clearly in FIG. 5, this automatic mechanical safety lock is accomplished by teeth 52 on the ratchet 50. The pitch of the teeth 52 determines the incremental locking positions for the safety mechanism. It has been found that a pitch or vertical spacing of about $1\frac{1}{2}$ inches is adequate for the safe operation of the lift 10. The lift 10 thus can be firmly locked into any vertical position at $1\frac{1}{2}$ inch increments.

The safety locking mechanism includes a spring biased and hydraulically released pawl mechanism 54 positioned to engage with the teeth 52 along the locking ratchet 50 on each side of the legs 30 and 32. An inwardly projecting detent 53 of the pawl 54 is positioned to releasably engage with the ratchet teeth 52. The pawl 54 is pivotally mounted on a pivot pin 56 provided on support plate 58. The support plate 58 in turn is mounted on one of a pair of mating gusset plates 60 and 62 provided on each side of an elevator platform assembly 100. In the preferred embodiment, a color coded flag portion 55 of the pawl 54 extends through an opening provided in the gusset 60. This color coded flag portion 55 is designed to provide a visible indication to the lift operator as to whether the pawl 54 is firmly engaged inwardly against the ratchet 50, or is retracted outwardly in a disengaged position. This feature adds to the safety and convenience of the lift 10.

The pawl 54 and its detent 53 are urged inwardly about the pin 56, into engagement with the teeth 52 of the ratchet 50, by force of gravity acting on the eccentrically pivoted mass of the pawl 54 and/or by a suitable spring 57 (See FIG. 5). This spring is designed so that a substantial selected force is required to overcome the spring and disenage the detent 53 from the teeth 52. In accordance with this invention, such a substantial disengaging force is generated by the piston 59, connected between support plate 58 and the gusset 60 and the pawl 54. The piston 59 will exert the force necessary to overcome the spring 57 and rotate the detent 53 out of engagement with the teeth 52 only when hydraulic pressure is available to activate the piston 59. In this manner, the pawl 54 is spring biased constantly into an engaging and locking position with the teeth 52 of the ratchet 50. Thus, the possibility that the elevator platform 100 will be accidentally lowered in response to a failure of hydraulic pressure in the system is substantially eliminated by this automatic mechanical safety mechanism. As shown in FIGS. 2 and 3, a pawl and ratchet safety mechanism is included adjacent each leg 30 and 32 of the lift 10.

The elevator platform assembly 100 of lift 10 includes a pair of cantilevered lifting arms 120 and 122. As shown in FIG. 2, the lifting arms 120 and 122 are formed from high-strength steel in a box-beam construction. They are attached to the support legs 30 and 32 in a manner which maximizes the accessibility to the truck F when the lift 10 elevates the truck above the base platform 22. The forward ends of the lifting arms 120, 122 are preferably sealed by a cap 124. A projecting toe guard extends around the front, sides and rear of each arm 120, 122 to prevent accidental injury to the toes of the operator when the arms are lowered onto a support surface parallel with the base platform 22.

In accordance with this invention, the lifting arms 120 and 122 are mounted for vertical movement on the support legs 30 and 32. To accomplish this arrangement, the rear of each arm is welded or otherwise firmly secured between the mating gusset plates 60 and 62. The arms 120, 122 and the plates 60, 62 are arranged so that the inner gusset plates 62 are closely positioned with respect to the associated support legs 30,32. The effect of the gusset plates 60,62 on the maximum clearance between the support legs 30,32 thereby minimized.

Suitable brackets 64 positioned between the adjacent gusset plates 60,62 connect the hydraulic cylinder 44 of each ram assembly 40 firmly to the gusset plates. The extension of the cylinder 44 and rod 42 will raise the gusset plates 60,62 and the associated lifting arms 120,122 during the operation of the service lift 10. Roller means are provided within the gussets 60,62 to transfer the load of the lifting arms 120,122 and the truck F being lifted to the rigid box-beam support legs 30,32. In this manner, any torsion force created by the load of truck F, which may otherwise interfere with the vertical extension and retraction of the rams 40 and the operation of the automatic ratchet and pawl safety mechanism is absorbed by the legs 30,32.

To transfer this load on the cantilevered arms 120,122 to the support legs 30,32 the gussets 60,62 include a pair of load bearing support rollers 66 and 68. As shown in the enlarged view of FIG. 4, each roller 66 and 68 is supported on an axle 67 which extends between the gusset plates 60 and 62. An angle iron 65 is also provided adjacent the rollers to define a protective housing for the rollers. The rollers 66 and 68 are offset vertically so that they effectively counteract the force couple or moment resulting from the load being applied to the cantilevered lifting arms 120,122 by the truck F. As seen in FIGS. 1 and 4, the front roller 66 is positioned in alignment with the associated lifting arm 120,122 in rolling engagement with the front face of the associated support legs 30,32. Likewise, the upper roller 68 is positioned between the top portion of the gussets 60,62 in rolling engagement with the rear face of the support legs 30,32. The downward force on the lifting arms 120,122 from the weight of the truck F, which tends to rotate the cantilevered arms downwardly, continuously urges the rollers 66 and 68 into engagement with the associated faces of the support legs 30,32. The rollers thereby continuously counteract the force created by the truck F, while permitting the lifting arms 120,122 and the truck F to be raised and lowered by the operation of the hydraulic rams 40. A support brace 61 extends between the adjacent gusset plates 60,62, as seen in FIG. 4, to add further strength and rigidity to the elevator platform assembly 100 which supports the load of the truck F.

During the operation of the lift 10, the truck F is supported between the spaced lifting arms 120,122 by a pair of pickup bars 130 and 140. As indicated in FIGS. 1 and 4, the rearward pickup bar 130 preferably is permanently affixed between the inside gusset plates 62 at the rear of the spaced lifting arms 120 and 122. This rearward bar 130 is therefore permanently located in a position which can receive and support the counterweighted rear end of the typical fork, lift truck F, as illustrated in FIG. 1. The bar 130 also is positioned to engage with the rear portion of other types of vehicles which may be serviced by the lift 10. The bar 130 is preferably a box beam made from steel plate for strength and rigidity.

As seen in FIGS. 1, 3 and 4, the forward edge of the bar 130 includes a gripping plate 132. This plate 132 comprises a steel plate welded to the bar 130 to project a selected distance, such as one-quarter to one-half inch above the top surface of the bar. The plate 132 will operate as a non-slip gripping edge which prevents the vehicles, such as truck F, from slipping forward on the bar 130 when the vehicle is elevated. A similar result can be achieved by the alternate use of an angle iron (not shown) welded to the upper forward corner of the bar 130 as the angle iron will overlie the rounded corner of bar 130 and provide a non-slip gripping edge.

Figure 3A:
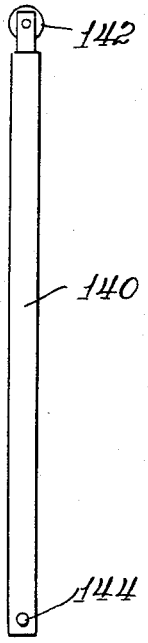
FIG. 3A is a removed view illustrating the movable pickup bar used in the service lift.
Figure 3:
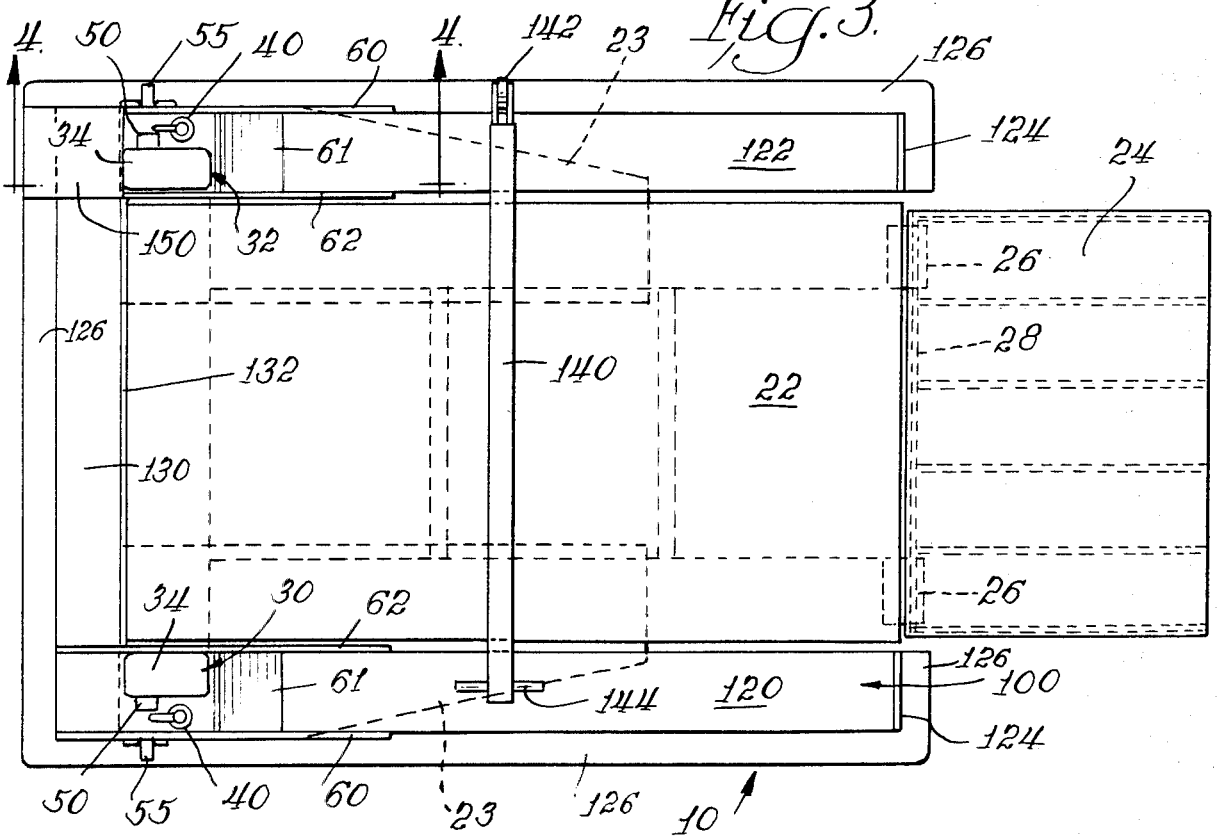
FIG. 3 is a top plan view of the service lift shown in FIG. 1.

The movable pickup bar 140, as illustrated in FIGS. 3 and 3A, preferably is made from a solid high-strength steel bar. The length of the bar 140 is selected so that it can extend beneath the front portion of truck F in a position supported on opposite ends by the lifting arms 120 and 122. Since a solid steel bar of such length has a substantial weight, the bar 140 is provided at one end with a roller 142 and at the other end with a set of handle grips 144. The roller 142 and grips 144 facilitate the movement of the pickup bar 140 by the operator of the light 10 into the proper position underneath the truck F. This pickup bar 140 is located in position beneath the truck F after the truck has been driven up the ramp 24 and onto the base platform 22. As shown in FIG. 2, the platform 22 is in horizontal alignment with the lifting arms 120 and 122 in the lowered position. The bar 140 can be readily placed beneath the truck F by transverse movement on the roller 142 along the platform 22 and the lifting arms 120,122. The weight of the truck F secures the bar 140 in position when the truck F is elevated.

The details of the electrically actuated hydraulic power unit 150, which energizes the lift 10 in accordance with this invention, are set forth in FIG. 4 of the drawings. The unit 150 is a self-contained modular system which is designed to fit between the gusset plates 60,62 on either side of the lift 10. A removable cover plate 152 allows ready access to the components of the unit 150 for maintenance and repair.

The power unit 150 includes a tank 154 in which the hydraulic fluid is stored. A standard pipe plug 155 at the lower end of the tank allows the tank to be drained. A suitable pump 156 is in fluid communication with the tank 154 by means of a conduit 157 and strainer 158. An electric motor 160 of approximately two horsepower operates the pump 156 to draw the hydraulic fluid from the tank 154. Conduits 159 circulate the pressurized fluid to the rams 40 and the cylinders 59 in the safety locking mechanism during the operation of the lift 10.

The control commands to the power unit 150 are communicated by the lift operator through a remote pendant push button control unit 170. In the illustrated embodiment, the control unit includes three separate control buttons representing three different modes or functions for the lift 10. An electrical cord 172 connects the control unit 170 to an electrical cabinet 174, and a power cord 176 provides the cabinet 174 with an external source of electrical power. Another cable 178 connects the cabinet 174 to the motor. The cabinet 174 includes conventional switching circuitry which controls the operation of the motor 160 to raise or lower the lift 10 by activating the rams 40. The circuitry in the cabinet 174 also operates the hydraulic cylinder 59 to move the pawl 54 and unlock the safety mechanism in response to the commands transmitted from the remote control unit 170.

The buttons on the control unit 170 can represent the separate functions of "up", "unlock" and "down", so that the depression of the buttons energizes the power unit 150 to raise the lift, unlock the safety locking mechanism and lower the lift, respectively. However, in the preferred embodiment, the control buttons on the unit 170 are arranged to perform the functions of "up", "lock" and "unlock/down." As explained further below, this preferred arrangement for the control unit 170 allows the power unit 150 to be operated to lower the elevated lift 10 a distance no greater than the pitch of the teeth 52 and thereby firmly engages the pawls 53 with one of the ratchet teeth 52.

The operation of the lift 10 is apparent from the above description of its component parts. First, the lift 10 is transported, by a fork lift truck or other suitable means, to the desired location where the service is to be performed. Since no lag bolts are needed to mount the lift 10, the lift can be placed readily on any smooth level support surface. The approach ramp 24 is then mechanically joined to the front of the base plaform 22 by engaging the tongue and groove connection 26,28 as shown in FIG. 1A. The fork lift truck F or other vehicle to be serviced is then driven up the ramp 24 onto the base platform 22. In placing the truck F on the platform 22, the operator should center the truck between the lifting arms 120,122 and the support legs 30,32, and also must place the rear end of the truck directly over the fixed pickup bar 130.

The next step in the use of the lift 10 is the placement of the movable pickup bar 140. The operator lifts the bar 140 by the grips 144 and rolls the bar into place on the roller 142. As shown in FIG. 1, the bar 140 is transversely extended under the front portion of the truck F so that the ends of the bar are resting firmly on the spaced lifting arms 120,122. The truck F is now positioned for elevation into the service position as shown in phantom in FIG. 1.

The elevating operation is started by operating the "up" button on the remote control unit 170. The power unit 150 is thereby activated to expand the lifting rams 40 and raise the lifting arms 120,122, the pickup bars 130 and 140, and the truck F into the desired elevated service position. As the truck F is raised, the pawl 54 automatically latches into engagement with the teeth 52 on the ratchet 50, due to gravity acting on the weight of the pawl and the action of the spring 57. The safety locking mechanism thus protects the operator from an accidental lowering of the lift 10.

The truck F is positioned for service or repair when the lift 10 is raised as shown in FIG. 1. The cantilevered design of the lift 10, and the allowable wide spacing between the support legs 30,32 and the lifting arms 120,122 provide substantial accessibility to the underside of truck F and to all wheel assemblies. The servicing and repair operations hence can be performed with ease, convenience and safety.

The preferred arrangement for the remote control unit 170 further enhances the safety of the lift 10 by assuring that the elevated lift is firmly supported by the safety locking mechanism. This increased safety is accomplished by momentarily operating the "lock" button on the control unit 170. The power unit 150 responds by lowering the lift a distance no greater than the pitch of the ratchet teeth 52. The pawls 54 thereby engage with the adjacent teeth 52 and firmly support the lift 10 in its elevated service position.

When the repair or service operation is completed, the remote unit 170 is activated in the preferred embodiment by depressing the "unlock/down" button. The power unit 150 responds by momentarily raising the lifting arms 120,122 to clear the pawls 54 from the teeth 52 of the ratchet 50. Then the power unit 150 continues to apply hydraulic pressure to the locking piston 59, to maintain the pawls 54 in an unlocked position, while exhausting the pressure from the lifting rams 40. The truck F is thereby lowered onto the base platform 22, and can be driven from the lift 10 down the ramp 22 after removing the lifting bar 140. The toe guards 126 protect the operator during the descent of the lifting arms 120,122 and the truck F. The lift 10 is then in condition to service another vehicle at the same location. Also, the lift then can be moved to another service location or into storage.

While the service lift apparatus has been disclosed with reference to an illustrative embodiment, it is to be understood that many changes in detail may be made as a matter of engineering choice without departing from the scope of the invention as defined in the appended claims.

What is claimed is:

1. A portable service lift for elevating equipment such as industrial vehicles comprising:

a base assembly for supporting said lift in a movable manner at one location and for allowing the lift to be readily moved to another location, said base assembly including a base platform having a selected length and width and onto which the equipment to be elevated can be driven;

a pair of support legs joined to and extending upwardly from said base platform, said legs being transversely spaced and disposed at opposite sides of one end of said platform to define a substantial opening therebetween for receiving a portion of the equipment to be elevated;

a pair of elongated lifting arms positioned on the outside of said opposite sides of said platform, each arm having a rear end adjacent one of said support legs and extending forwardly along a side of said platform so that equipment placed on said platform is positioned between said arms and the area beneath said arms when lifted is totally unobstructed in a direction transversely across said platform;

means for movably joining each lifting arm in cantilevered fashion to the adjacent support leg including support means rigidly joined to each arm adjacent said rear end and extending upwardly adjacent the associated support leg; first roller means rotatably mounted on said support means in rolling engagement with a front face on the associated support leg; and second roller means rotatably mounted on said support means in rolling engagement with an opposing rear face on the associated support leg and spaced vertically a selected distance from said first roller means; whereby said first and second roller means continuously support said cantilevered lifting arms of said support legs as said arms are raised or lowered with respect to said base platform;

first lifting bar means extending transversely across the rear ends of said lifting arms in a position to extend beneath one portion of said equipment to be lifted as said equipment is moved onto said base platform;

second lifting bar means having a length selected to extend across said lifting arms beneath another portion of said equipment stationed on said base platform, whereby said first and second lifting bar means engage with and support spaced portions of said equipment as said lifting arms are raised with respect to said base platform;

lifting means operably associated between the rear ends of said lifting arms and said support legs for raising and lowering said arms along said support legs to raise and lower said equipment supported between said arms;

safety locking means connected between at least one of said lifting arms and support legs and operable to releasably lock said arms in any of a plurality of elevated positions as said arms and equipment are raised with respect to said base platform; and control means selectively operable to energize said lifting means and to release said safety locking means so that said equipment can be selectively raised and lowered with respect to said base platform.

2. A portable service lift in accordance with claim 1 wherein said safety locking means comprises an elongate ratchet positioned to extend vertically and connected to one of said support legs and a pawl joined to the adjacent lifting arm in a position to releasably engage said ratchet as said lifting arm is raised with respect to said support leg.

3. A portable service lift in accordance with claim 2 wherein said pawl includes indicia to visually differentiate between the location of said pawl in a locked position engaged with said ratchets and an unlocked position released from said ratchets.

4. A portable service lift in accordance with claim 2 wherein said pawl is biased into engagement with said ratchet and wherein said lift includes releasing means selectively operable to overcome said biasing means and release said pawl from engagement with said ratchet.

5. A portable service lift in accordance with claim 4 wherein said releasing means comprises an expandable hydraulic cylinder connected to said pawl and activated by said control means.

6. A portable service lift in accordance with claim 2 wherein each adjacent lifting arm and support leg is provided with a safety locking means comprising said elongate ratchet and said engaging pawl.

7. A portable service lift in accordance with claim 6 wherein said lift includes a hydraulic cylinder connected to each of said pawls and adapted to be activated by said control means to release said pawls from engagement with the associated ratchet and thereby release said safety locking means.

8. A portable service lift in accordance with claim 6 wherein each pawl includes indicia to visually differentiate between the location of said pawls in a locked position engaged with said ratchet and an unlocked position released from said ratchet.

9. A portable service lift for elevating equipment such as industrial vehicles comprising:

a base assembly for supporting said lift in a movable manner at one location and for allowing the lift to be readily moved to another location, said base assembly including a base platform having a selected length and width for receiving the equipment to be elevated;

a pair of support legs joined to and extending upwardly from said base platform, said legs being transversely spaced along opposite sides of said platform to define a substantial opening therebetween for receiving a portion of the equipment to be elevated;

a pair of elongated lifting arms positioned on opposite sides of said platform, each arm having a rear end adjacent one of said support legs and extending forwardly along a side of said platform so that equipment placed on said platform is positioned between said arms;

means for movably joining each lifting arm in cantilevered fashion to the adjacent support leg including support means rigidly joined to each arm adjacent said rear end and extending upwardly adjacent the associated support leg; first roller means rotatably mounted on said support means in rolling engagement with a front face on the associated support leg; and second roller means rotatably mounted on said support means in rolling engagement with an opposing rear face on the associated support leg and spaced vertically a selected distance from said first roller means, whereby said first and second roller means continuously support said cantilevered lifting arms on said support legs as said arms are raised or lowered with respect to said base platform;

a rigid fixed lifting bar extending transversely between the rear ends of said lifting arms in a position to receive one end of the equipment to be lifted, said fixed lifting bar including an upwardly projecting gripping edge extending along the forward portion of said bar to firmly engage the equipment to be lifted with said bar;

second lifting bar means having a length selected to extend across said lifting arms beneath another portion of said equipment stationed on said base platform, whereby said first and second lifting bar means engage with and support spaced portions of said equipment as said lifting arms are raised with respect to said base platform;

lifting means operable for raising and lowering said arms along said support legs to raise and lower said equipment supported between said arms;

safety locking means connected between at least one of said lifting arms and support legs and operable to releasably lock said arms in any of a plurality of elevated positions as said arms and equipment are raised with respect to said base platform; and control means selectively operable to energize said lifting means and to release said safety locking means so that said equipment can be selectively raised and lowered with respect to said base platform.

10. A portable service lift for elevating equipment such as industrial vehicles comprising:

a base assembly for supporting said lift in a movable manner at one location and for allowing the lift to be readily moved to another location, said base assembly including a base platform having a selected length and width for receiving the equipment to be elevated and a removable ramp adapted to mechanically interlock with a front end of said base platform so that said equipment to be elevated can be easily placed on said base platform and said ramp can be removed readily from said platform, said mechanical interlock between said ramp and base platform comprising a tongue and groove connection;

a pair of support legs joined to and extending upwardly from said base platform, said legs being transversely spaced along opposite sides of said platform to define a substantial opening therebetween for receiving a portion of the equipment to be elevated;

a pair of elongated lifting arms positioned on opposite sides of said platform, each arm having a rear end adjacent one of said support legs and extending forwardly along a side of said platform so that equipment placed on said platform is positioned between said arms;

means for movably joining each lifting arm in cantilevered fashion to the adjacent support leg including support means rigidly joined to each arm adjacent said rear end and extending upwardly adjacent the associated support leg; first roller means rotatably mounted on said support means in rolling engagement with a front face on the associated support leg; and second roller means rotatably mounted on said support means in rolling engagement with an opposing rear face on the associated support leg and spaced vertically a selected distance from said first roller means, whereby said first and second roller means continuously support said cantilevered lifting arms on said support legs as said arms are raised or lowered with respect to said base platform;

first lifting bar means extending transversely across the rear ends of said lifting arms in a position to extend beneath one portion of said equipment to be lifted as said equipment is moved onto said base platform;

second lifting bar means having a length selected to extend across said lifting arms beneath another portion of said equipment stationed on said base platform, whereby said first and second lifting bar means engage with and support spaced portions of said equipment as said lifting arms are raised with respect to said base platform;

lifting means operable for raising and lowering said arms along said support legs to raise and lower said equipment supported between said arms;

safety locking means connected between at least one of said lifting arms and support legs and operable to releasably lock said arms in any of a plurality of elevated positions as said arms and equipment are raised with respect to said base platform; and control means selectively operable to energize said lifting means and to release said safety locking means so that said equipment can be selectively raised and lowered with respect to said base platform.

11. A portable service lift for elevating equipment such as industrial vehicles comprising:

a base assembly for supporting said lift in a movable manner at one location and for allowing the lift to be readily moved to another location, said base assembly including a base platform having a selected length and width for receiving the equipment to be elevated;

a pair of support legs joined to and extending upwardly from said base platform, said legs being transversely spaced along opposite sides of said platform to define a substantial opening therebetween for receiving a portion of the equipment to be elevated;

a pair of elongated lifting arms positioned on opposite sides of said platform, each arm having a rear end adjacent one of said support legs and extending forwardly along a side of said platform so that equipment placed on said platform is positioned between said arms;

means for movably joining each lifting arm in cantileverd fashion to the adjacent support leg including support means comprising a pair of spaced gusset plates rigidly joined to each arm adjacent said rear end and extending upwardly adjacent the associated support leg; first roller means rotatably mounted between said spaced gusset plates in rolling engagement with a front face on the associated support leg; and second roller means rotatably mounted between said spaced gusset plates in rolling engagement with an opposing rear face on the associated support leg and spaced vertically a selected distance from said first roller means, whereby said first and second roller means continuously support said cantilevered lifting arms on said support legs as said arms are raised or lowered with respect to said base platform;

first lifting bar means extending transversely across the rear ends of said lifting arms in a position to extend beneath one portion of said equipment to be lifted as said equipment is moved onto said base platform;

second lifting bar means having a length selected to extend across said lifting arms beneath another portion of said equipment stationed on said base platform, whereby said first and second lifting bar means engage with and support spaced portions of said equipment as said lifting arms are raised with respect to said base platform;

lifting means operable for raising and lowering said arms along said support legs to raise and lower said equipment supported between said arms, said lifting means comprising a hydraulic ram extending upwardly along the outer side of each support leg and connected between said base assembly and at least one gusset plate of the adjacent lifting arm so that the hydraulic expansion of said ram applies a substantial lifting force to the respective lifting arm through the gusset plate;

safety locking means connected between at least one of said lifting arms and support legs and operable to releasably lock said arms in any of a plurality of elevated positions as said arms and equipment are raised with respect to said base platform; and control means selectively operable to energize said lifting means and to release said safety locking means so that said equipment can be selectively raised and lowered with respect to said base platform.

12. A portable service lift for elevating equipment such as industrial vehicles comprising:

a base assembly for supporting said lift in a movable manner at one location and for allowing the lift to be readily moved to another location, said base assembly including a base platform having a selected length and width and onto which the equipment to be elevated can be driven;

a pair of support legs joined to and extending upwardly from said base platform, said legs being transversely spaced and disposed at opposite sides of one end of said platform to define a substantial opening therebetween for receiving a portion of the equipment to be elevated;

a pair of elongated lifting arms positioned on the outside of said opposite sides of said platform, each arm having a rear end adjacent one of said support legs and extending forwardly along a side of said platform so that equipment placed on said platform is positioned between said arms and the area beneath said arms when lifted is totally unobstructed in a direction trnasversely across said platform;

means for movably joining each lifting arm in cantilevered fashion to the adjacent support leg including support means rigidly joined to each arm adjacent said rear end and extending upwardly adjacent the associated support leg; first roller means rotatably mounted on said support means in rolling engagement with a front face on the associated support leg; and second roller means rotatably mounted on said support means in rolling engagement with an opposing rear face on the associated support leg and spaced vertically a selected distance from said first roller means; whereby said first and second roller means continuously support said cantilevered lifting arms on said support legs as said arms are raised or lowered with respect to said base platform;

first lifting bar means extending transversely across the rear ends of said lifting arms in a position to extend beneath one portion of said equipment to be lifted as said equipment is moved onto said base platform;

second lifting means having a length selected to extend across said lifting arms beneath another portion of said equipment stationed on said base platform, whereby said first and second lifting bar means engage with and support spaced portions of said equipment as said lifting arms are raised with respect to said base platform; and lifting means operably associated between the rear ends of said lifting arms and said support legs for raising and lowering said arms along said support legs to raise and lower said equipment supported between said arms.

* * * * *